US008375560B2

(12) United States Patent
Tsai et al.

(10) Patent No.: US 8,375,560 B2
(45) Date of Patent: Feb. 19, 2013

(54) METHOD FOR MANUFACTURING A CONDENSER MICROPHONE

(75) Inventors: Jean-Yih Tsai, Taichung (TW); Chung-Ching Lai, Taichung (TW); Chao-Chih Chang, Taichung (TW)

(73) Assignee: Taiwan Carol Electronics Co., Ltd., Taichung (TW)

( * ) Notice: Subject to any disclaimer, the term of this patent is extended or adjusted under 35 U.S.C. 154(b) by 53 days.

(21) Appl. No.: 13/031,931

(22) Filed: Feb. 22, 2011

(65) Prior Publication Data

US 2012/0210560 A1 Aug. 23, 2012

(51) Int. Cl.
*H04R 31/00* (2006.01)

(52) U.S. Cl. ..... 29/594; 29/25.42; 29/609.1; 367/178; 367/190; 381/174; 381/191; 438/3; 438/42; 438/57; 438/98

(58) Field of Classification Search ..... 29/25.42, 29/594, 602.1, 609.1, 876, 877; 381/174, 381/191; 367/178, 180; 438/3, 42, 57, 98
See application file for complete search history.

(56) References Cited

U.S. PATENT DOCUMENTS

| | | | | |
|---|---|---|---|---|
| 7,269,268 | B2 * | 9/2007 | Song et al. | 381/174 |
| 7,327,851 | B2 * | 2/2008 | Song | 381/174 |
| 7,469,461 | B2 * | 12/2008 | Chang et al. | 29/594 |
| 7,903,831 | B2 * | 3/2011 | Song | 381/174 |
| 2004/0114775 | A1 * | 6/2004 | Chang | 381/191 |

* cited by examiner

*Primary Examiner* — Paul D Kim
(74) *Attorney, Agent, or Firm* — Law Offices of Albert Wai-Kit Chan, PLLC

(57) ABSTRACT

A method for manufacturing a condenser microphone includes forming a diaphragm module using microelectromechanical system (MEMS) techniques. The diaphragm module includes a diaphragm that is deformable by energy of sound waves, and a diaphragm spacer that extends from one side of the diaphragm and controls a tension of the diaphragm. The method further includes providing a backplate with vent holes, aligning the vent holes of the backplate with a central region of the diaphragm, and connecting the backplate to the diaphragm spacer to construct a transducer unit. The diaphragm spacer, the diaphragm and the backplate cooperate to form an air chamber in fluid communication with an environment external to the condenser microphone. The backplate and the diaphragm cooperate to form a condenser. The method further includes enclosing the transducer unit in a housing that includes a shell and a circuit board to form the condenser microphone.

4 Claims, 5 Drawing Sheets

METHOD FOR MANUFACTURING A CONDENSER MICROPHONE

BACKGROUND OF THE INVENTION

1. Field of the Invention

The invention relates to a method for manufacturing a microphone, more particularly to a manufacturing method for a condenser microphone.

2. Description of the Related Art

Referring to FIG. 1, a conventional condenser microphone 1 includes a housing 11, a transducer unit 12 packaged in the housing 11, and an electric component 14.

The housing 11 includes a shell 111 that permits sound waves to enter thereinto, and a printed circuit board (PCB) 112. The transducer unit 12 is compactly packaged in the housing 11, and cooperates with the printed circuit board 112 to confine an accommodation space 13. The electric component 14 is a field-effect transistor (FET), and is accommodated in the accommodation space 13 and coupled electrically to the transducer unit 12 and the printed circuit board 112. The transducer unit 12 includes a circuit board spacer 121, a backplate 122, a diaphragm spacer 123, a diaphragm 124 and a grounded spacer 126.

The circuit board spacer 121 is an insulator, is disposed to surround the electric component 14, and is mounted on the printed circuit board 112. The backplate 122 is mounted to the circuit board spacer 121, is formed with a plurality of vent holes 127, and cooperates with the circuit board spacer 121 and the printed circuit board 112 to confine the accommodation space 13 to accommodate the electric component 14. The diaphragm spacer 123 is mounted on the backplate 122. The diaphragm 124 is mounted on the diaphragm spacer 123 and cooperates with the diaphragm spacer 123 and the backplate 122 to confine an air chamber 125 in fluid communication with the external environment through the vent holes 127. The diaphragm 124 cooperates with the backplate 122 to forma condenser. The grounded spacer 126 is conductively mounted on a side of the diaphragm 124 opposite to the diaphragm spacer 123, and cooperates with the shell 111 and the printed circuit board 112 to ground the diaphragm 124.

In use, sound waves enter the shell 111 to deform the diaphragm 124 and to vary the capacitance of the condenser formed by the diaphragm 124 and the backplate 122. The variation of the capacitance is converted into electrical signals via the electric component 14 for subsequent output to the external environment.

One method for manufacturing another conventional condenser microphone is disclosed in U.S. Pat. No. 7,327,851, which involves assembly of a large number of components, that involve longer manufacturing time and reduced production efficiency. Moreover, variation in each component's sensitivity to environmental conditions such as temperature and humidity may make it more difficult to control performance characteristics of the final product.

As such, further improvements to conventional manufacturing methods for the condenser microphone are still desired in the art.

SUMMARY OF THE INVENTION

Therefore, the object of the present invention is to provide a method for manufacturing a condenser microphone that has a simplified process and a higher production efficiency, and that reduces effects on the manufacturing process by environmental factors such as temperature, humidity, etc.

The method for manufacturing a condenser microphone according to this invention comprises forming a diaphragm module using microelectromechanical system (MEMS) techniques. The diaphragm module includes a diaphragm that is deformable by energy from sound waves, and a diaphragm spacer that extends from one side of the diaphragm and controls a tension of the diaphragm. The method further includes providing a backplate with vent holes, aligning the vent holes of the backplate with a central region of the diaphragm, and connecting the backplate to the diaphragm spacer to construct a transducer unit. The diaphragm spacer, the diaphragm and the backplate cooperate to form an air chamber in fluid communication with an environment external to the condenser microphone. The backplate and the diaphragm cooperate to form a condenser. The method further includes enclosing the transducer unit in a housing that includes a shell and a circuit board to form the condenser microphone. The housing permits the sound waves to enter and reach the transducer unit.

By using MEMS techniques to make a diaphragm module with a simplified structure, effects on product quality by environmental factors may be reduced. In addition, the overall manufacturing time is greatly reduced, while the production yield is increased.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
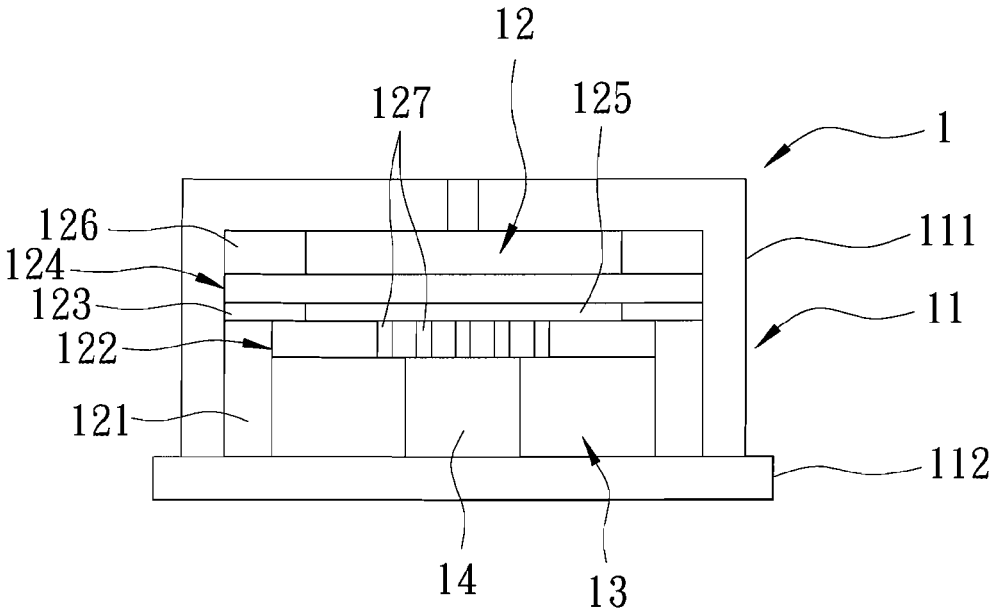
FIG. 1 PRIOR ART
FIG. 1 is a schematic diagram of a conventional condenser microphone.

Before the present invention is described in greater detail with reference to the accompanying preferred embodiments, it should be noted herein that like elements are denoted by the same reference numerals throughout the disclosure.

Figure 2:
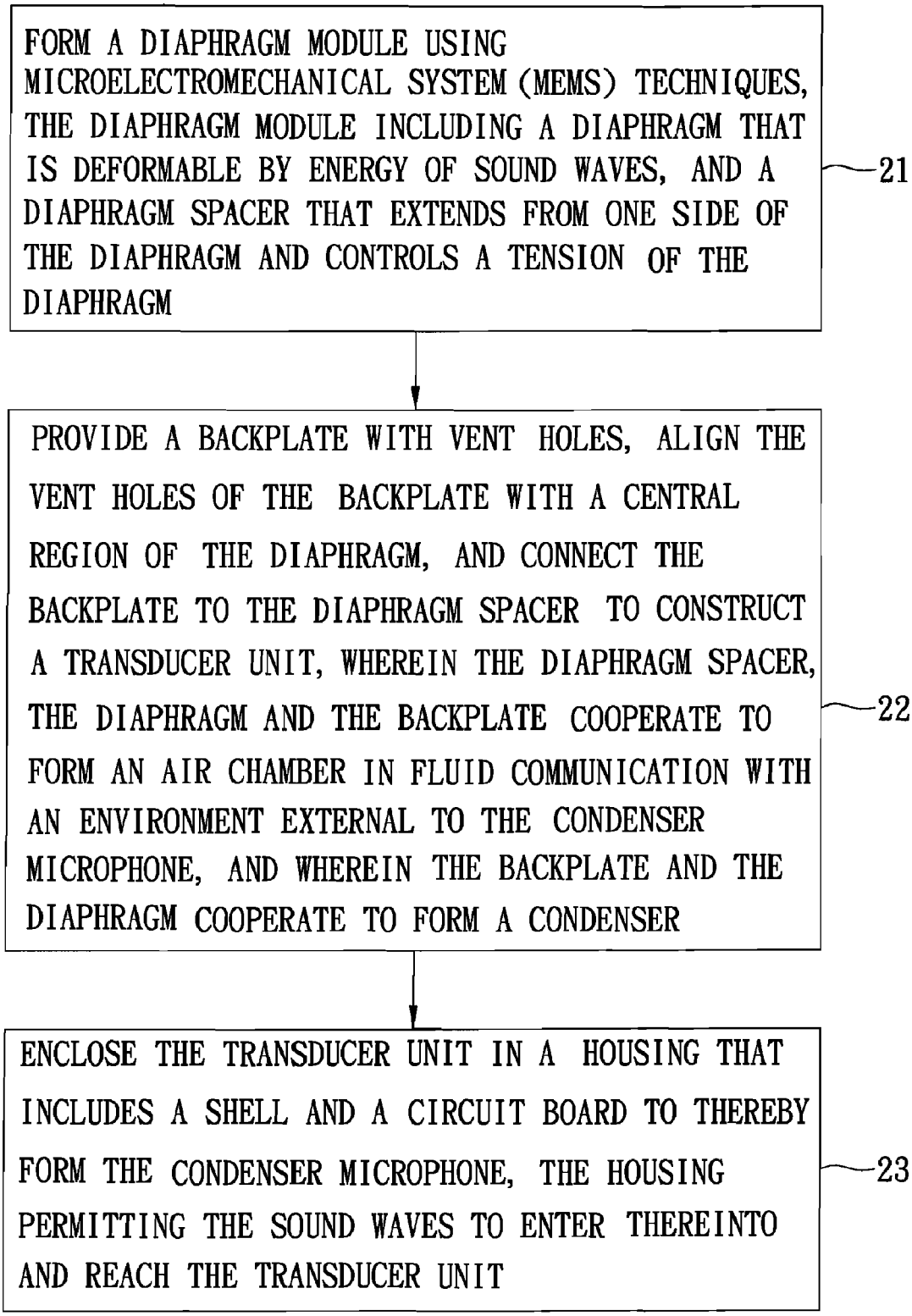
FIG. 2 is a flowchart of the first preferred embodiment of a method for manufacturing a condenser microphone according to the present invention.
Figure 3A:
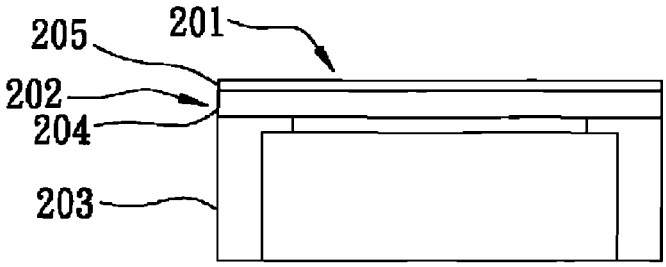
FIGS. 3A through 3C are schematic diagrams illustrating manufacture of the condenser microphone according to the first preferred embodiment of the present invention.
Figure 3B:
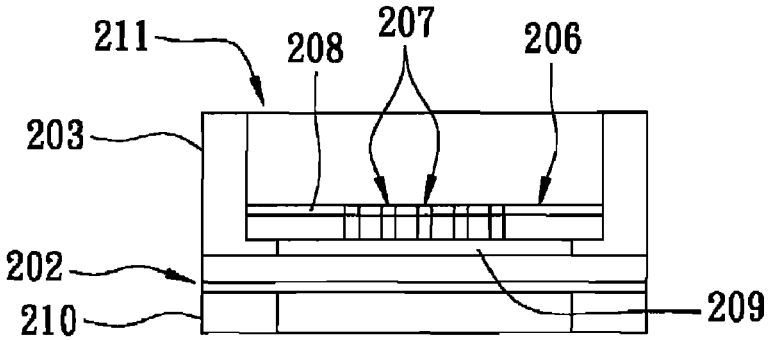
Figure 3C:
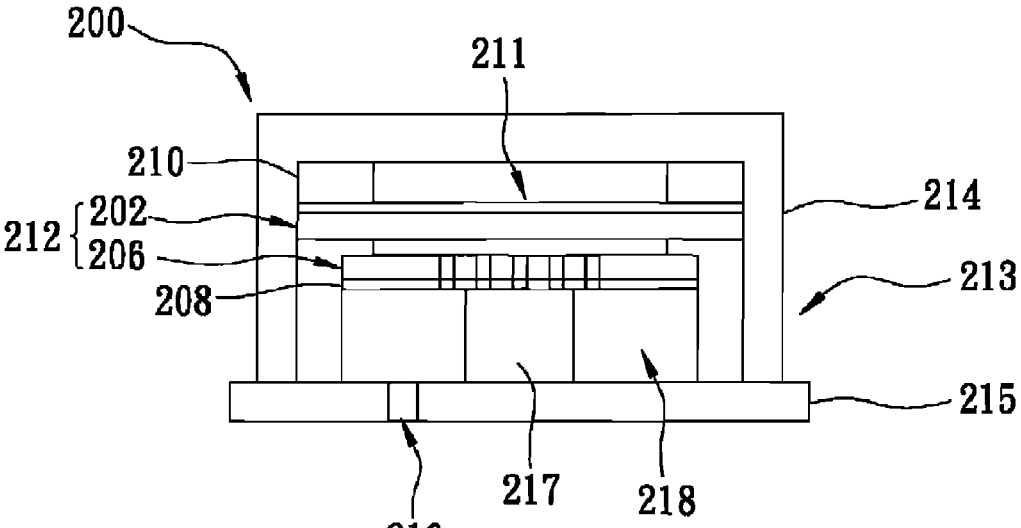

Referring to FIG. 2, the first preferred embodiment of a manufacturing method for a condenser microphone according to the present invention is shown to include steps 21 to 23 for manufacturing a condenser microphone 200 as shown in FIG. 3C.

Referring further to FIG. 3A, step 21 is first executed to form a diaphragm module 201 using microelectromechanical system (MEMS) techniques. To form the diaphragm module 201, a diaphragm 202 and a diaphragm spacer 203. The diaphragm module 201 further includes a vibration layer 204 that is deformable and a conductive layer 205 that is conductive and disposed above the vibration layer 204 are formed in sequence over a substrate by one or more techniques such as sputtering, evaporation, deposition, spin coating, and other associated methods. The vibration layer 204 and the conductive layer 205 cooperate to form the diaphragm 202, and the substrate is etched according to a predetermined pattern to form the diaphragm spacer 203. In this manner, the diaphragm module 201 is completely produced. The diaphragm 202 is deformable by energy of sound waves, the diaphragm spacer 203 controls a tension of the diaphragm 202, and the conductive layer 205 is made of a conductive material capable of being grounded.

Referring further to FIG. 3B, in step 22, vent holes 207 of a prefabricated backplate 206 with a back conductive layer 208 are aligned with a central region of the diaphragm 202. The backplate 206 is then connected to the diaphragm spacer 203 such that the diaphragm 202, the diaphragm spacer 203 and the backplate 206 form an air chamber 209 in fluid communication with an external environment through the vent holes 207. A prefabricated conductive shell spacer 210 is then adhered to a top surface of the diaphragm 202 of the diaphragm module 201 to form a transducer unit 211. In this embodiment, the backplate 206 is placed over the diaphragm spacer 203, and the back conductive layer 208 is made of a conductive material. Preferably, the backplate 206 is adhered to the diaphragm spacer 203. The backplate 206 and the diaphragm 202 cooperate to form a condenser 212 that can receive energy of sound waves for generating electric signals.

Referring further to FIG. 3C, in step 23, the transducer unit 211 is enclosed in or packed into a housing 213 that includes a shell 214 and a circuit board 215 and that permits sound energy to enter thereinto. In this way, the condenser microphone 200 is manufactured. The circuit board 215 is formed with a sound hole 216 for passage of sound waves, and includes an electric component 217 connected electrically to the back conductive layer 208 of the backplate 206. The electric component 217 is accommodated in an accommodation space 218 formed among the diaphragm spacer 203, the backplate 206 and the circuit board 215. The electric component 217 abuts against the backplate 206 and is coupled electrically to the back conductive layer 208 of the backplate 206 so that the signals generated by the condenser 212 are outputted to the external environment using the backplate 206, the electric component 217, and the circuit board 215. Moreover, the diaphragm 202 of the packaged condenser microphone 200 utilizes the conductive layer 205 to form a ground connection with the conductive shell spacer 210, the shell 214, and the circuit board 215.

It should be noted herein that, in this embodiment, the diaphragm 202 is grounded through the conductive shell spacer 210. However, grounding may be accomplished using a wire bond that electrically connects the diaphragm 202 and the circuit board 215. Adhesion to the conductive shell spacer 210 is therefore not essential.

Although in this embodiment, the backplate 206 is coupled electrically to the electric component 217 through the back conductive layer 208, the backplate 206 can be made of conductive material, such that an additional back conductive layer 208 is not needed.

Figure 4:
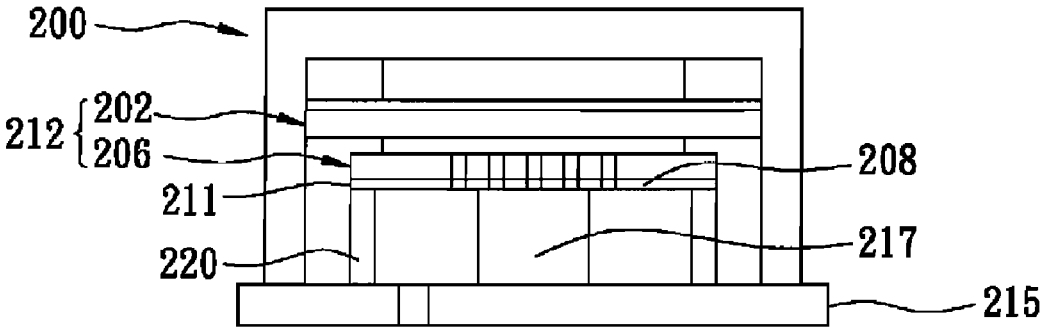
FIG. 4 is a schematic diagram illustrating a variation of the first preferred embodiment of this invention.

Referring to FIG. 4, the condenser microphone 200 can be made with a conductive ring 220. The backplate 206 can then be coupled electrically to the electric component 217 of the circuit board 215 through the back conductive layer 208 of the backplate 206, the conductive ring 220 and the circuit board 215 such that the electric signals generated by the condenser 212 are outputted to the external environment. Moreover, by abutting the conductive ring 220 against the backplate 206, when the backplate 206 is placed over the diaphragm 202, there is no need for support from the electric component 217. The position of the electric component 217 can therefore be varied, such as on a bottom side of the circuit board 215, in the accommodation space 218, etc.

Figure 5:
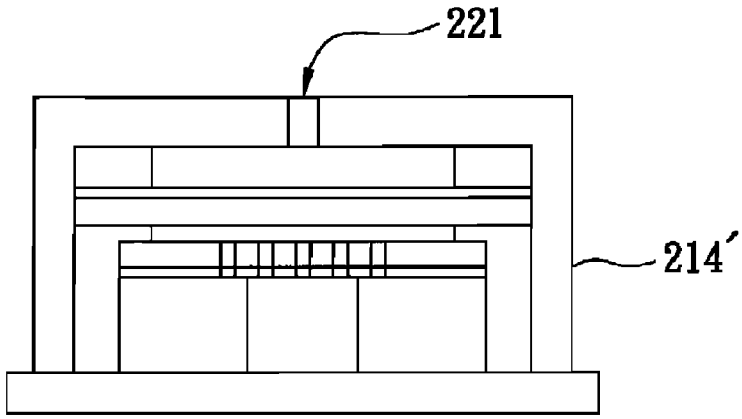
FIG. 5 is a schematic diagram illustrating another variation of the first preferred embodiment of this invention.

As shown in FIG. 5, a sound hole 221 for passage of sound waves can be formed on a shell 214'.

Figure 6:
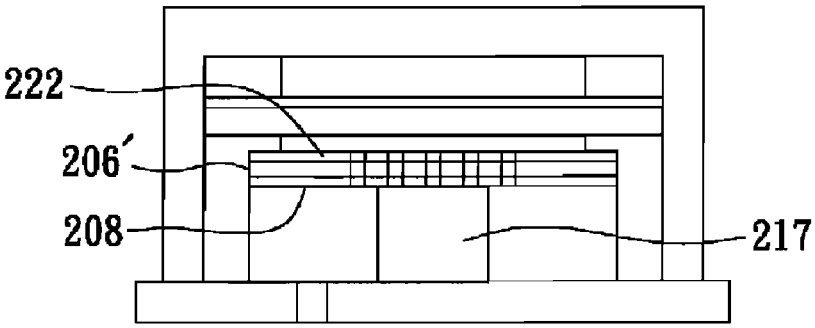
FIG. 6 is a schematic diagram illustrating yet another variation of the first preferred embodiment of this invention.

As shown in FIG. 6, an electret layer 222 made of an electret material is formed on a side of the backplate 206' opposite to the back conductive layer 208. The back conductive layer 208 thus does not need an external voltage supply.

As described above, this invention uses MEMS techniques to make a diaphragm module 201 that includes the diaphragm 202 and the diaphragm spacer 203 and that has a simpler structure. The diaphragm 202 is incorporated with the prefabricated conductive shell spacer 210, the backplate 206, and the other parts described above to produce the transducer unit 211. The transducer unit 211 can then be packaged in the housing 213 that includes the shell 214 and the circuit board 215 to assemble the condenser microphone 200.

In comparison with the conventional manufacturing method of prefabricating each component and then stacking them individually to make a condenser microphone, this invention makes the diaphragm module 201 using MEMS techniques, so that the condenser microphone 200 maintains high product sensitivity. Moreover, because the number of components of the entire packaging operation is significantly reduced, the overall manufacturing time is greatly reduced, and the production yield is increased. Furthermore, since the components are assembled using adhesion, the condenser microphone 200 is composed with minimal affect from environmental factors such as temperature, humidity, etc.

In comparison with other conventional manufacturing methods, this invention not only makes the diaphragm module 201 using MEMS techniques to effectively increase product sensitivity, but also simplifies the structure of the diaphragm module 201, which significantly reduces the complexity of the MEMS manufacturing procedures. Hence, the incurred manufacturing cost of the condenser microphone 200 is significantly reduced.

Figure 7A:
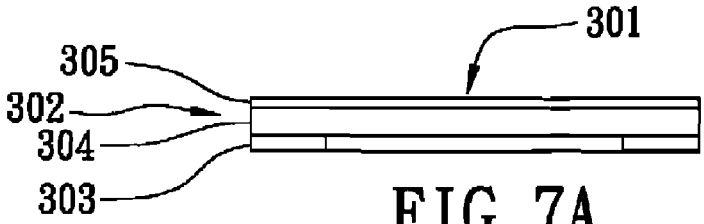
FIGS. 7A to 7C are schematic diagrams illustrating the second preferred embodiment of a method for manufacturing a condenser microphone according to the present invention.
Figure 7B:
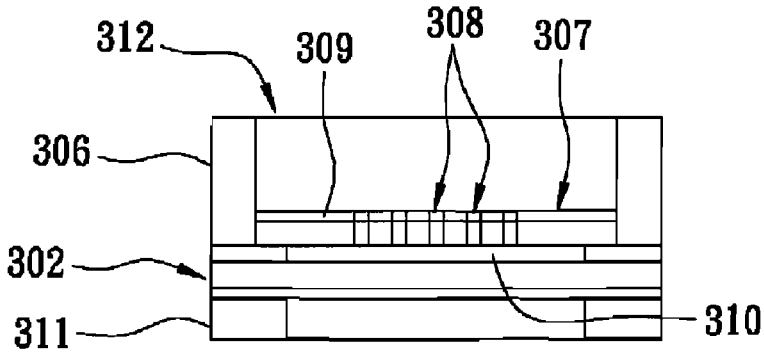
Figure 7C:
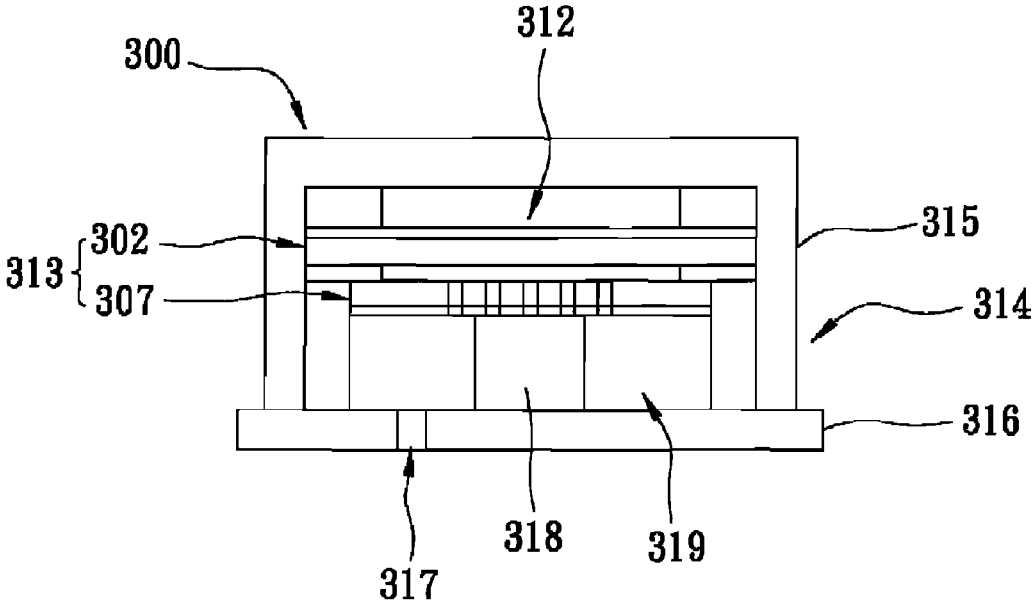

The second preferred embodiment of a manufacturing method of a condenser microphone according to the present invention is shown to include steps 21 to 23 for manufacturing a condenser microphone 300 as shown in FIG. 7C.

Referring to FIG. 7A, step 21 is first executed using MEMS techniques for producing a diaphragm module 301 that includes a diaphragm 302 and a diaphragm spacer 303. To form the diaphragm module 301, a vibration layer 304 that is deformable and a conductive layer 305 that is conductive and that is disposed above the vibration layer 304 are formed in sequence over a substrate by one or more techniques such as sputtering, evaporation, deposition, spin coating, etc. The vibration layer 304 and the conductive layer 305 cooperate to form the diaphragm 302, and the substrate is etched according to a predetermined pattern to form the diaphragm spacer 303. In this way, the diaphragm module 301 is completely produced.

Referring to FIG. 7B, in step 22, a prefabricated insulating circuit board spacer 306 is adhered to the diaphragm spacer 303. Then, a plurality of vent holes 308 of a prefabricated backplate 307 with a back conductive layer 309 are aligned with a central region of the diaphragm 302. The backplate 307 is then connected to the diaphragm spacer 303 such that the diaphragm 302, the diaphragm spacer 303 and the backplate 307 form an air chamber 310 in fluid communication with the external environment through the vent holes 309. Next, a prefabricated conductive shell spacer 311 is adhered to a top surface of the diaphragm 302 of the diaphragm module 301 to form a transducer unit 312. The backplate 307 and the diaphragm 302 cooperate to forma condenser 313 that can receive energy of sound waves for generating electric signals.

Referring to FIG. 7C, in step 23, the transducer unit 312 is packed into a housing 314 that includes a shell 315 and a circuit board 316 and that permits sound energy to enter thereinto. In this way, the condenser microphone 300 is manufactured. The circuit board 316 is formed with a sound hole 317 passage of sound waves, and includes an electric component 318 connected electrically to the back conductive layer 309 of the backplate 307. The electric component 318 is accommodated in an accommodation space 319 among the circuit board spacer 306, the backplate 307 and the circuit board 316. Moreover, the electric component 318 abuts against the backplate 307 and is coupled electrically to the back conductive layer 309 of backplate 307.

In comparison with the first preferred embodiment, after the diaphragm spacer 303 as shown in FIG. 7A is manufactured using MEMS techniques, the circuit board spacer 306 is adhered. The complexity of the production method using the diaphragm spacer 203 for disposing the backplate 206 as shown in FIG. 3B is significantly reduced. In addition, the time needed for manufacturing the diaphragm spacer 303 is also greatly reduced, which accordingly reduces the complexity and manufacturing time of the applied MEMS techniques.

In sum, in comparison with conventional condenser microphone manufacturing methods, this invention not only increases product quality by making the diaphragm module 201, 301 using MEMS techniques, but it also simplifies the structure of the diaphragm module 201, 301. The complexity of the MEMS techniques and the incurred manufacturing costs are therefore significantly reduced.

While the present invention has been described in connection with what are considered the most practical and preferred embodiments, it is understood that this invention is not limited to the disclosed embodiments but is intended to cover various arrangements included within the spirit and scope of the broadest interpretation to encompass all such modifications and equivalent arrangements.

What is claimed is:

1. A method for manufacturing a condenser microphone, comprising:

(A) forming a diaphragm module using microelectromechanical system (MEMS) techniques, the diaphragm module including a diaphragm that is deformable by energy of sound waves, and a diaphragm spacer that extends from one side of the diaphragm and controls a tension of the diaphragm;

(B) providing a backplate with vent holes, aligning the vent holes of the backplate with a central region of the diaphragm, and connecting the backplate to the diaphragm spacer to construct a transducer unit, wherein the diaphragm spacer, the diaphragm and the backplate cooperate to form an air chamber in fluid communication with an environment external to the condenser microphone, and wherein the backplate and the diaphragm cooperate to form a condenser; and (C) enclosing the transducer unit in a housing that includes a shell and a circuit board to thereby form the condenser microphone, the housing permitting the sound waves to enter thereinto and reach the transducer unit, wherein the diaphragm of the diaphragm module made in step (A) includes a vibration layer and a conductive layer formed on the vibration layer, and step (B) further includes adhering a conductive shell spacer to another side of the diaphragm opposite to the diaphragm spacer for forming a ground connection between the diaphragm and the circuit board via the conductive layer, the shell spacer and the shell.

2. The method as claimed in claim 1, wherein step (B) includes adhering the backplate to the diaphragm spacer.

3. The method as claimed in claim 1, wherein in step (C), the circuit board is formed with a sound hole for passage of the sound waves, and an electric component is coupled electrically to the backplate such that the condenser microphone is configured to receive the sound waves via the sound hole, to convert the sound waves to an electric signal using the condenser, and to output the electric signal using the backplate, the electric component, and the circuit board.

4. The method as claimed in claim 1, wherein step (B) further includes adhering an insulating circuit board spacer to the diaphragm spacer such that, when the transducer unit is installed in the housing, the backplate, the circuit board spacer, and the circuit board cooperate to form an accommodation space for accommodating an electric component.

* * * * *